United States Patent [19]

Beckham

[11] 4,146,137

[45] Mar. 27, 1979

[54] ADJUSTABLE UNIT FOR SPIRAL SEPARATOR

[75] Inventor: Lewis S. Beckham, West Lafayette, Ind.

[73] Assignee: Purdue Research Foundation, West Lafayette, Ind.

[21] Appl. No.: 736,257

[22] Filed: Oct. 27, 1976

[51] Int. Cl.[2] ..... B07B 13/11

[52] U.S. Cl. ..... 209/696

[58] Field of Search ..... 209/112, 115, 116, 117, 209/696–697

[56] References Cited

U.S. PATENT DOCUMENTS 976,980 11/1910 Blatch ..... 209/117

*Primary Examiner*—Stanley H. Tollberg

*Assistant Examiner*—Charles A. Marmor

*Attorney, Agent, or Firm*—John R. Nesbitt

[57] ABSTRACT

An apparatus is disclosed for an adjustable movable unit for a spiral separator seed cleaning machine. The apparatus may take a variety of forms depending on the particular spiral separator it is to be mounted upon. The movable unit mounts on a rod and is movable about that rod. Attached to this unit are one or more fingers which act as seed dams upon the inner flights of the spiral separator. The number of fingers corresponds to the number of inner flights. A set of these units attached to a rod is fixed to each half of the spiral separator. On the normal double spiral separator in use in most soybean seed cleaning operations, two sets of adjustable units consisting of four units each are required.

6 Claims, 7 Drawing Figures

ADJUSTABLE UNIT FOR SPIRAL SEPARATOR

BACKGROUND OF THE INVENTION

The problem of removing foreign material and imperfect soybean seed from good soybean seed has existed since soybeans have been grown as a crop. As this problem was recognized, the spiral separator was adapted for processing soybean seed.

The spiral separator is a machine used to process agricultrual seed. It was originally designed to remove vetch seed from wheat seed. The machine is currently being used to process soybean seed. The machine separates whole soybean seed from contaminants such as corn, split soybean seed, moldy soybeans and impurities that do not roll as freely as whole soybeans. The machine separates seeds based on shape, density, and degree of roundness or ability to roll.

The spiral separator consists of one or more inner sheet metal flights spirally wound around a central axis. Seed is discharged onto the upper end of these flights. Nearly spherical seed travels at a faster rate than less round seed. Seed momentum increases until the round seeds roll off the edge of the inner spirals and are caught in the outer spiral. The good seed in the outer spiral and the contaminants which remain on the inner spirals are discharged separately from the machine. The rate of incline in the spirals and the banking angle of the flights are predetermined and fixed by the manufacturer.

The only adjustment on commercially existing spiral separators is rate of feed of the seed into the machine.

The two major disadvantages of the spiral separator are lack of flexibility in adjustment and low capacities. The lack of adjustment prevents fine-tuning the machine in order to make precise separations. Separations may be made only between good seed and contaminants with gross differences in shape, density and roundness.

In 1970 an article was published in *Mississippi Farm Research* (Vol. 33, No. 4, April 1970) on the use of seed dams to improve the action of the spiral separator. This device used wooden strips fastened to the inner flights with clothes pins. It was reported that, without the seed dams, 1%–3% of the seed of purple moon flower (a contaminant) remained in the good seed. With the seed dams, 99.9% of the purple moon flower seed were removed. Loss of good seed was 3% with the strips versus 1.9% without the strips.

A different type of seed dam has been recommended and used by Purdue University seed technologists. These consist of magnetic strips which are placed on the inner flights. Action and performance of these dams are identical to those used by Mississippi State University.

Both the wooden and magnetic seed dams have serious shortcomings in operation. First, the angle of the seed dams relative to a line tangent to the edge of the inner flight is critcal. In installing, and adjusting the angle of the seed dams, the machine must be shut down. The actual adjustment procedure is difficult and time consuming because of the inaccessibility of the seed dams. Secondly, the dams, as used, rarely stay in place once they are positioned. This means that constant readjustment is required for optimum separation.

SUMMARY OF THE INVENTION

This invention provides an adjustable unit for a spiral separator seed processing machine. A set of fingers (one for each corresponding inner flight of the spiral separator) is attached to a unit. A set of these units mount on a rod, one of which is attached to each half of the spiral separator. The fingers act as seed dams. The position of the unit containing the fingers is infinitely variable within limits. The unit and the corresponding angle of the fingers tangent to the edge of the inner flights may be adjusted at any time whether the machine is in operation or not.

It is therefore an object of this invention to provide a unit which changes a spiral separator into an adjustable, more versatile machine.

It is another object of this invention to provide a type of seed dam which is infinitely adjustable within predetermined limits.

It is another object of this invention to provide a type of seed dam that may be adjusted while the spiral separator machine is in operation.

It is another object of this invention to provide a unit that increases both the cleaning capacity and cleaning precision of the spiral separator machine.

With these and other objects in view, which shall become apparent to one skilled in the art as the description proceeds, this invention resides in the novel construction, combination, and arrangement of parts substantially as hereinafter described, and more particularly defined by the appended claims, it being understood that such changes in the precise embodiment of the hereindisclosed invention are meant to be included as come within the scope of the claims.

BRIEF DESCRIPTION OF THE DRAWINGS

The accompanying drawings illustrate one complete embodiment of the invention according to the best mode so far devised for the practical application of the principles thereof, in which.

DETAILED DESCRIPTION OF THE INVENTION

Figure 1:
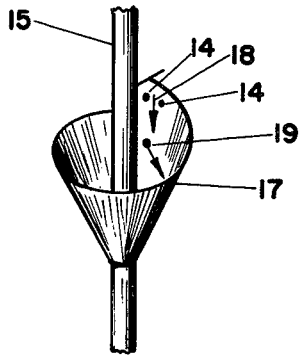
FIG. 1 illustrates an inner flight of the spiral separator.

The basic operation of the spiral separator is illustrated in FIG. 1. The seed are discharged onto a plane (inner flight) 19 which is spirally wound around a central shaft 15. The seeds 14 travel on the surface of the plane 19 in the direction indicated by arrow 18. As seed speed increases, centrifugal force carries the seed toward the outer edge 17 of the inner flight 19. In theory, only good seed travel over the edge of inner flight 19. Contaminants in the good seed, which are less round and less dense, fail to achieve a velocity sufficient to carry them over the outer edge 17 of the flight.

Figure 2:
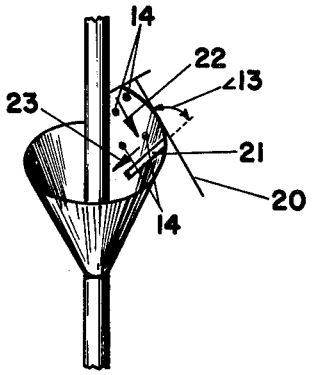
FIG. 2 PRIOR ART
FIG. 2 shows the concept of operation of the seed dam as practiced in the prior art.

In practice, many contaminants actually do roll over the edge of the inner flight at some point. Prior art machines attempted to solve this problem by placing a seed dam 21 (shown in FIG. 2) across the path 22 of the seed 14. By using a series of these dams, the seed mass was continually impeded and slowed and directed as shown by arrow 23 as it traveled down the plane. The angle 13 of the dam 21 to an imaginary line 20 tangential to the outer edge of the inner flight is critical. Angle 13 must be selected so that dam 21 slows contaminants but does not contain good seed. Since the composition within seed lots as well as between lots is never consistent, constant adjustment of angle 13 is necessary to maximize cleaning efficiency.

The major drawbacks of the prior art have to do with adjusting angle 13. First, because of the inaccessability of the dams adjustment is difficult. Second, because of the manner in which the dams are attached they rarely stay in place.

The herein described invention solves both of the problems of the prior art with additional improvements to the basic spiral separator.

Figure 3:
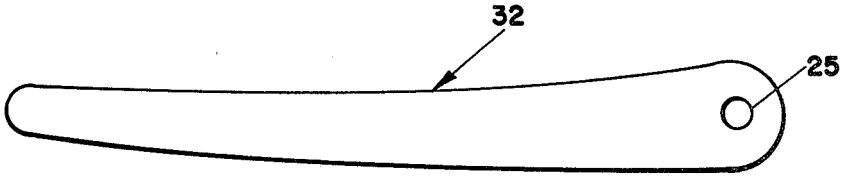
FIG. 3 is a side view of a movable finger removed from a movable unit.

FIG. 3 shows one of the fingers 32 which act as a seed dam. The finger may be made from any rigid or semi-rigid material and should be sufficiently long so that when at a tangential angle of 45° to the outer edge of the inner flight, 3 to 6 inches of the finger is operating as a seed dam. The aperture 25 in the finger 32 is the point of attachment to a movable unit. Aperture 25 must be sufficiently large so that finger 32 has free rotation within limits around the pin 28 which attaches it to the movable unit 12.

Figure 4:
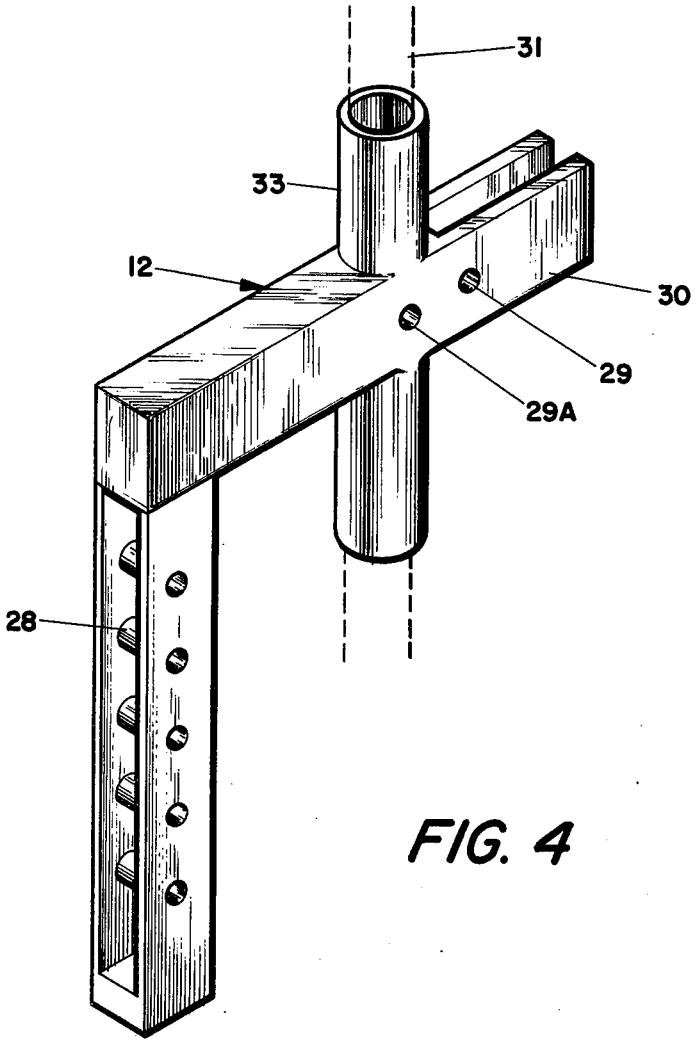
FIG. 4 is a perspective view of a movable unit without the movable fingers.
Figure 5:
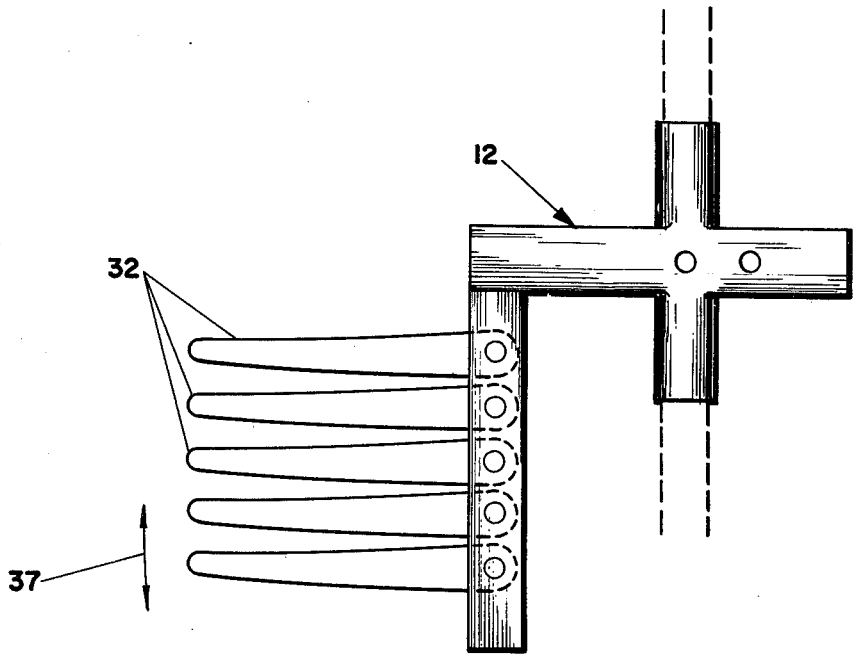
FIG. 5 is a perspective view of a complete movable unit.

One finger 32 is required on each movable unit 12 for each inner flight of the spiral separator. The movable units 12 shown in FIG. 4 and FIG. 5 are designed for spiral separators having 5 inner flights. Distance between the fingers 32 should be within 20% of the vertical distance between the inner flights.

FIG. 4 shows the movable unit without the fingers. The movable unit includes pins 28 for the attachment of the fingers 32; a cylindrical portion 33 for attachment to a metal rod 31 (not shown); an aperture 29 for a clamp if the cylinder is split or an aperture **29*a* for a set screw if the cylinder is entire; a handle 30** for turning the unit on the rod.

FIG. 5 shows the complete movable unit. The fingers, when attached, have a limited vertical rotation path 37 on pins 28.

Figure 6:
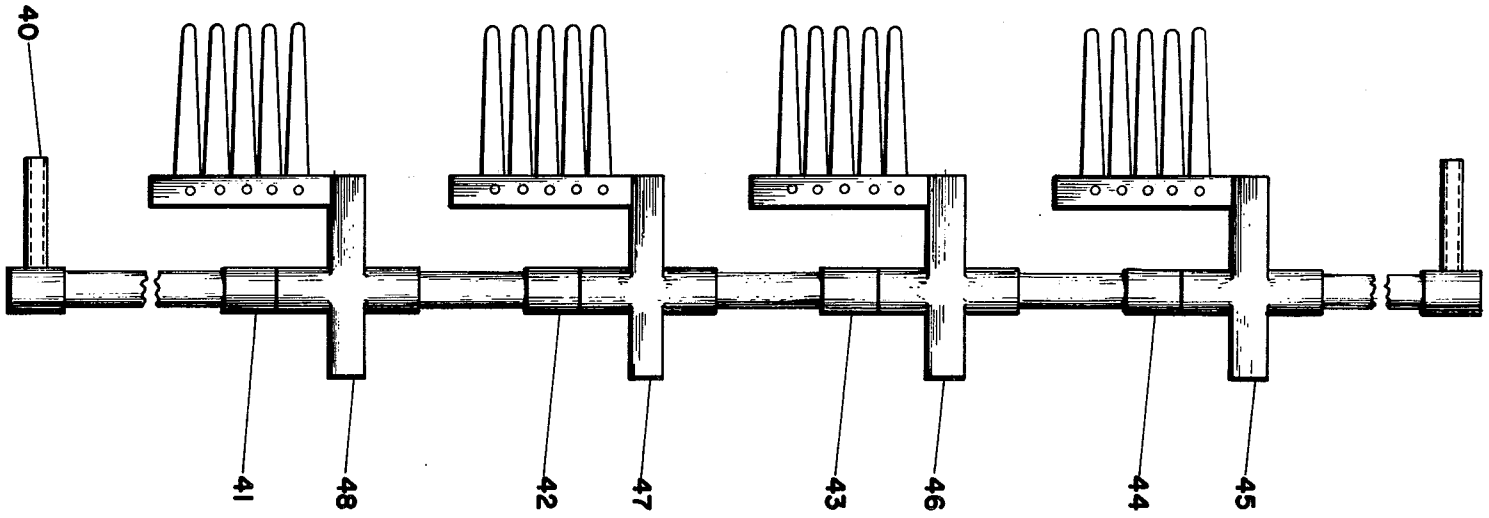
FIG. 6 is a side view of a set of movable units mounted on a rod with all other fittings.
Figure 7:
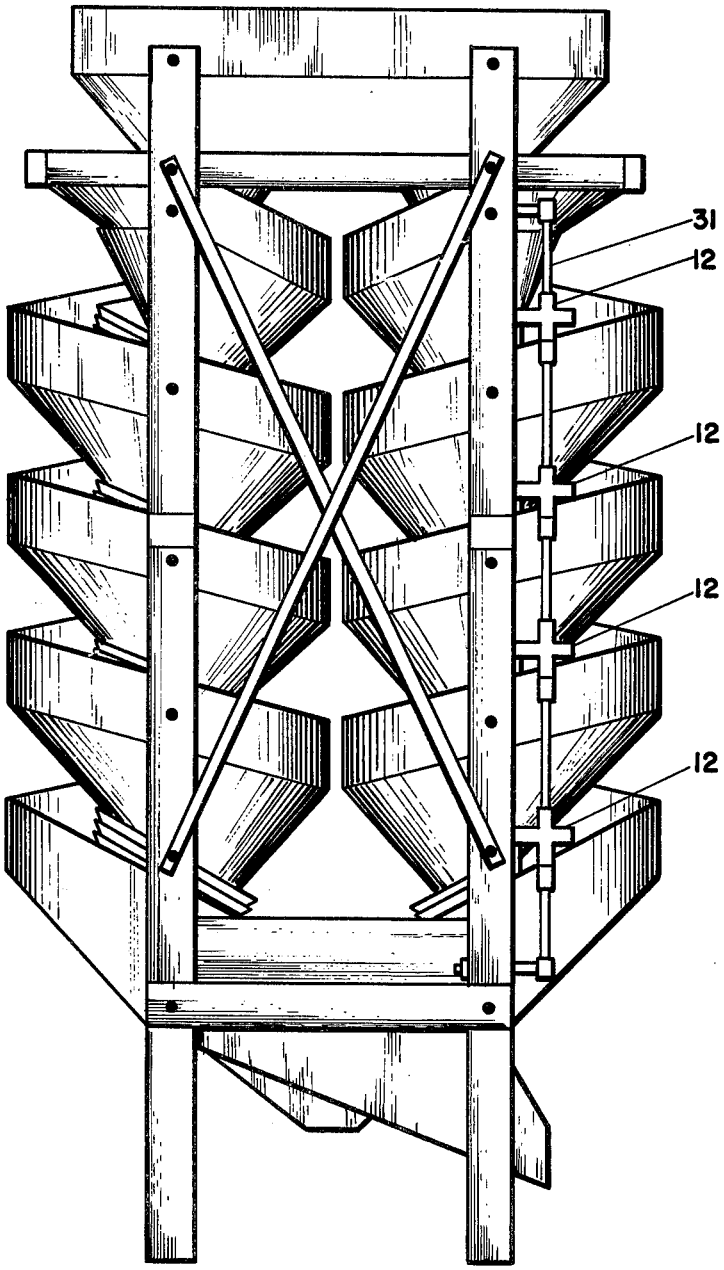
FIG. 7 is a perspective view of a spiral separator with a complete set of movable units mounted on one half of the spiral separator.

FIG. 6 shows a set of movable units mounted on a rod. Spacers 41, 42, 43 and 44 are fixed to the rod below each movable unit. These limit the vertical movement of the movable units on the rod. The complete apparatus is attached to the spiral separator by means of bolts 40 or other fasteners and may be attached to the frame, or mounting structure, of the spiral separator by being mounted thereon as shown in FIG. 7, the mounting structure also having the flights mounted thereon as also indicated in FIG. 7.

Using a set of movable units 45, 46, 47 and 48 increases both the cleaning efficiency and capacity of the spiral separator. Without the movable units, essentially all of the separation occurs in the top 18 to 24 inches of the spiral separator. By adding the movable units, the effective length of the machine is increased. The effect is a significant increase in capacity. Increases over 50% have been observed.

I claim:

1. In a spiral separator seed processing device having a plurality of groups of inner spirals spaced along a substantially vertical central shaft mounted on a mounting structure, an adjustable seed dam, comprising:

a mounting rod mounted on said mounting structure of said seed processing device with said rod being substantially vertically positioned outwardly of and adjacent to said inner spirals;

a plurality of substantially horizontal arms;

a sleeve connected with each of said horizontal arms and having said mounting rod received therein so that said arms are rotatable about a substantially vertical axis and vertically spaced from one another;

a finger mount depending downwardly from one end portion of each of said horizontal arms with each of said finger mounts having a plurality of substantially horizontally positioned and vertically spaced pivot pins mounted thereon; and a plurality of groups of fingers, said groups being equal to at least a portion of the number of groups of inner spirals of said seed processing device with each of said groups having a plurality of fingers equal in number to the number of inner spirals of each associated group thereof, each of said fingers being elongated and having an aperture at the inner end portion with each of said fingers being mounted on a different one of said pivot pins of said finger mounts whereby each of said fingers can pivot about a substantially horizontal axis so that said fingers are positioned for normal operation contiguous to associated ones of said inner spirals of said seed processing device to provide a seed dam thereat to facilitate separation of good seed from contaminants.

2. In a seed processing device for separating good seed from contaminants with said device having inner flights positioned on a substantially vertically positioned central shaft mounted on a mounting structure and with said inner flights having an upper surface positioned to receive said good seed and contaminants, an adjustable seed dam comprising:

a substantially vertically positioned mounting rod mounted on said mounting structure adjacent to said inner flights;

mounting arms having a finger mounting portion and a rod mounting portion for mounting said arms on said mounting rod with said arms being rotatable about a substantially vertical axis; and a plurality of elongated fingers having one portion mounted on said finger mounting portion of said mounting arms whereby each of said fingers can pivot about a substantially horizontal axis, and a second portion contiguous to said inner flights with each finger being positioned for normal operation contiguous to said upper surface of an associated inner flight of said seed processing device to provide a seed dam thereat to facilitate separation of good seed and contaminants.

3. The adjustable seed dam of claim 2 wherein said seed processing device includes a plurality of inner flights, and wherein said finger means includes a plurality of fingers a different one of which is contiguous to each of said plurality of inner flights.

4. The adjustable seed dam of claim 2 wherein said rod mounting portion of each of said mounting arms is a sleeve having said mounting rod received therein.

5. The adjustable seed dam of claim 2 wherein said finger mounting portion of each of said mounting rods is a finger mount having a plurality of substantially horizontally positioned and vertically spaced pivot pins mounted thereon, and wherein said fingers are mounted on said pivot pins.

6. In a spiral separator seed processing device having a plurality of groups of inner spirals spaced along a substantially vertically central shaft mounted on a mounting structure, and adjustable seed dam, comprising:

a mounting rod mounted on said mounting structure of said seed processing device with said rod being substantially vertically positioned outwardly of and adjacent to said inner spirals;

a plurality of mounting arms;

first mounting means for mounting each of said mounting arms on said mounting rod so that said arms are rotatable about a substantially vertical axis and vertically spaced from one another;

second mounting means connected with said mounting arms; and a plurality of groups of fingers, said groups being equal to at least a portion of the number of groups of inner spirals of said seed processing device with each of said groups having a plurality of fingers equal in number to the number of inner spirals of each associated group thereof, each of said fingers being elongated and mounted at one end on said second mounting means whereby each of said fingers can pivot about a substantially horizontal axis so that said fingers are positioned for normal operation contiguous to associated ones of said inner spirals of said seed processing device to provide a seed dam thereat to facilitate separation of good seed from contaminants.

* * * * *